United States Patent [19]

Franke

[11] 4,216,382

[45] Aug. 5, 1980

[54] X-RAY DIAGNOSTIC GENERATORS WITH AN INVERTER FEEDING ITS HIGH VOLTAGE TRANSFORMER

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 14,583

[22] Filed: Feb. 23, 1979

[30] Foreign Application Priority Data

Apr. 3, 1978 [DE] Fed. Rep. of Germany ..... 2814320

[51] Int. Cl.[2] ..... H05G 1/30

[52] U.S. Cl. ..... 250/408; 250/402; 250/421

[58] Field of Search ..... 250/401, 402, 408, 421, 250/418

[56] References Cited

U.S. PATENT DOCUMENTS 3,828,194 8/1974 Grasser ..... 250/402

*Primary Examiner*—Craig E. Church
*Assistant Examiner*—Thomas P. O'Hare
*Attorney, Agent, or Firm*—Hill, Van Santen, Steadman, Chiara & Simpson

[57] ABSTRACT

In an exemplary embodiment, two inverters of which each exhibits a switching installation controlled by a control circuit for the alternate connection of two output lines with the power rectifier. The control signals supplied to the inverters by the control circuit are out of phase with one another, so that the x-ray tube voltage possesses a low ripple component.

3 Claims, 4 Drawing Figures

X-RAY DIAGNOSTIC GENERATORS WITH AN INVERTER FEEDING ITS HIGH VOLTAGE TRANSFORMER

BACKGROUND OF THE INVENTION

The invention relates to an x-ray diagnostic generator with an x-ray tube, a high voltage transformer feeding the x-ray tube, an inverter circuit connected to the input of the high voltage transformer and a power rectifier feeding the inverter.

In an x-ray diagnostic generator of this type, it is possible to select the feeding frequency of the x-ray tube in the kHz range, i.e. significantly higher than the power network frequency. Because of this high inverter output frequency, the high voltage transformer can be constructed significantly smaller and lighter than in the case of an x-ray diagnostic generator which is operated with the network frequency.

SUMMARY OF THE INVENTION

The object of the invention is to design an x-ray diagnostic generator of the type initially cited in such manner that the ripple component of the voltage supplied to the x-ray tube is small.

This object is inventively achieved in that the inverter circuit consists of two inverters, each of which exhibits a switching installation controlled by a control installation for the alternate connection of two output lines with the power rectifier; and in that the control signals supplied to the inverter from the control installation are out of phase with one another. Because of the phase displacement of the control signals, the output voltages appearing on the output lines are also out of phase with one another. Since a voltage lies at the x-ray tube that corresponds to the sum of voltages on the output lines, this voltage possesses a low ripple.

It is particularly practical to provide two high voltage transformers whose primary parts are connected to one respective inverter output and whose secondary parts are connected respectively to one of two high voltage rectifiers connected in series. In this embodiment, the output voltages of the two high voltage rectifiers superimpose themselves to provide the resultant voltage at the x-ray tube.

In the following, the invention is explained in greater detail on the basis of the accompanying sheet of drawing; and other objects, features and advantages will be apparent from this detailed disclosure and from the appended claims.

DETAILED DESCRIPTION

Figure 1:
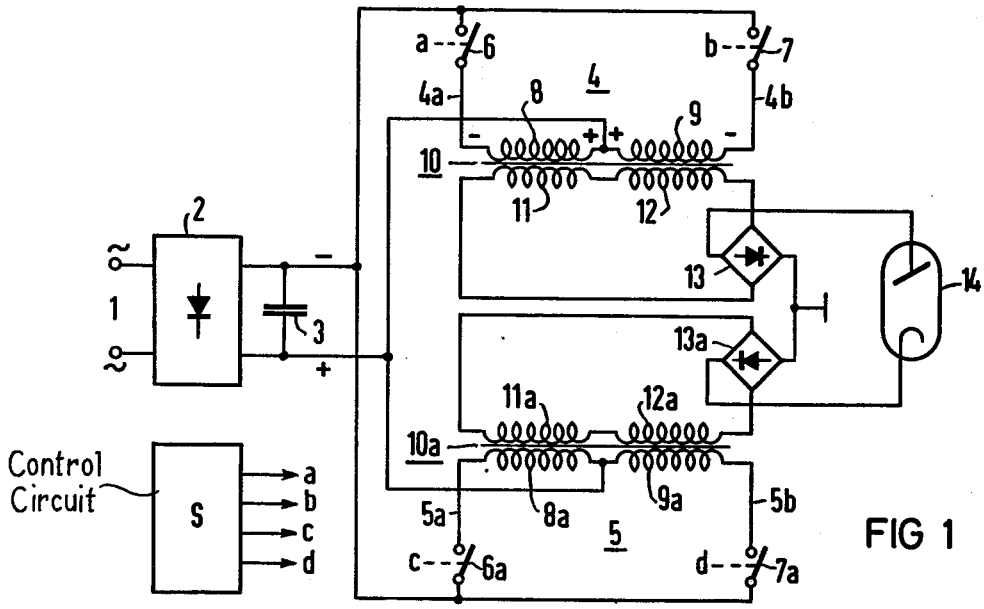
FIG. 1 is an electric circuit diagram showing an x-ray diagnostic generator according to the invention.

In FIG. 1, a power rectifier 2 connected to power network terminals 1 is illustrated, whose output voltage is smoothed by means of a capacitor 3. The constant voltage at capacitor 3 forms the input voltage for two inverters 4 and 5 which are only schematically illustrated in FIG. 1. The inverter 4 has two switches 6 and 7 which are alternately closed by means of a control circuit S. The switches 6 and 7 are, for practical purposes, electronic switches. They alternately connect the primary winding parts 8 and 9 of a high voltage transformer 10 to the constant voltage of capacitor 3. The high voltage transformer 10 has two secondary winding parts 11 and 12 connected in series to one another, whose sum voltage lies at the input of a full wave bridge rectifier 13.

The inverter 5 is constructed in the same manner as the inverter 4. Its component parts have the same reference numbers, but are distinguished from the component parts of the inverter 4 by means of an "a". The output voltage of the inverter 5 is supplied to a high voltage full wave bridge rectifier 13*a*.

According to FIG. 1, each of the inverters 4, 5 exhibit two output lines 4*a*, 4*b* or 5*a*, 5*b*, respectively, which are alternately connected with the power rectifier 2 or the capacitor 3, respectively, by means of the switches 6, 7 or 6*a*, 7*a*, respectively.

To explain the operation of the inverter 4, let it be assumed that the switch 6 is closed by the control circuit S. Thereby, the primary winding part 8 is connected to the constant voltage of the capacitor 3 with the polarity indicated. When the switch 6 is opened and, subsequently, the switch 7 is closed, then the primary winding part 9 is connected to constant voltage with the indicated polarity. Accordingly, an approximately sinusoidal alternating voltage corresponding to the waveform indicated by dash line 13-1 in FIG. 2 lies at the output of the high voltage rectifier 13.

Figure 2:
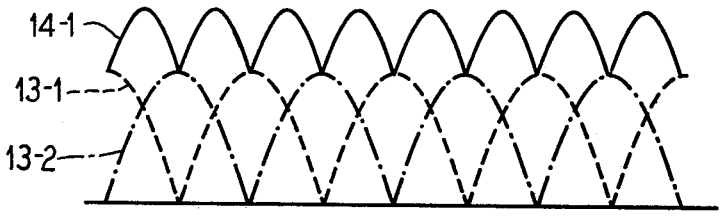
FIG. 2 shows waveforms for explaining the operation of the generator according to FIG. 1.

The operation of the inverter 5 is the same as that of the inverter 4. The control signals for the switches 6*a* and 7*a*, which are delivered by the control circuit S, however, are temporally displaced with respect to the control signals supplied to the switches 6 and 7 in such manner that the output voltage of the high voltage rectifier 13*a* is displaced by 90° with respect to the output voltage of the high voltage rectifier 13 and corresponds with the waveform indicated by dot-dash line 13-2 in FIG. 2. The voltage at the x-ray tube, which is illustrated in FIG. 2 with the solid line 14-1 is the sum of the output voltages of the rectifiers 13 and 13*a*. According to FIG. 2, it has a small ripple component.

Figure 3:
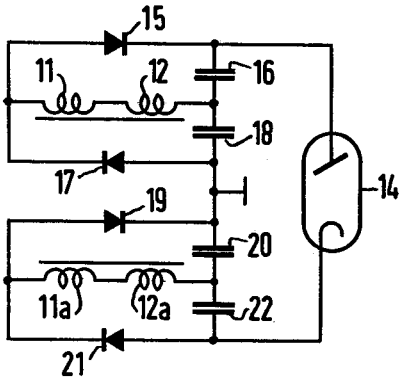
FIGS. 3 and 4 are circuit diagrams showing variations of the x-ray diagnostic generator according to FIG. 1.

In FIG. 3, the high voltage circuit of the x-ray generator according to FIG. 1 is illustrated in a variation. The secondary winding parts 11 and 12 or 11*a* and 12*a*, respectively, lie in two circuits each consisting of a diode and a capacitor, 15, 16; 17, 18; 19, 20; 21, 22. Each of the capacitors 16, 18, 20, 22 is charged to the peak voltage at the secondary winding parts 11, 12, so that the four-fold peak voltage lies at the x-ray tube 14. For example, if the peak voltage at one of the series circuits 11, 12 or 11*a*, 12*a*, respectively, amounts to 20 kV, then the x-ray tube voltage amounts to 80 kV. In the example according to FIG. 1, the x-ray tube voltage in this case amounts to the doubled peak voltage, namely, for example, 40 kV.

Figure 4:
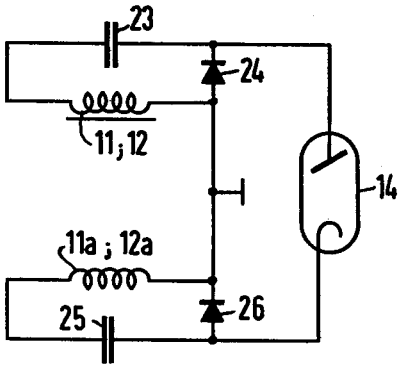

The example according to FIG. 4 also represents a voltage doubling circuit. In this case, the secondary winding parts 11, 12 and 11*a*, 12*a* are illustrated as a single winding. These winding parts feed a circuit consisting of a capacitor 23 and a diode 24 or a capacitor 25 and a diode 26, respectively. Thereby, the doubled voltage of the voltage at the secondary winding parts 11, 12 or 11*a*, 12*a*, respectively, lies at the diodes 24 and 26, so that, in this case, too, the x-ray tube voltage has the four-fold value of the voltage at the series circuit of two secondary winding parts 11, 12 or 11*a*, 12*a*, respectively.

In the examples according to FIGS. 3 and 4, too, the ripple component of the x-ray tube voltage is reduced in comparison to that case in which a single inverter is present. In these examples, too, the control pulses for the inverter 5 are displaced by 90° in comparision with the control pulses for the inverse rectifier 4.

It will be apparent that many modifications and variations may be effected without departing from the scope of the novel concepts and teachings of the present invention.

I claim as my invention:

1. An x-ray diagnostic generator with an x-ray tube, high voltage transformer means feeding the x-ray tube, an inverter circuit connected to the input of the high voltage transformer means, and a power rectifier feeding the inverter, characterized in that the inverter circuit comprises two inverters (4 and 5) of which each has pulsing means (6, 7, 6*a*, and 7*a*) controlled for the alternate connection of the transformer means to the power rectifier (2), and in that the control signals supplied to the inverters (4 and 5) are out of phase with one another, said transformer means comprising two high voltage transformers (10 and 10*a*), whose secondary windings (11, 12, 11*a*, and 12*a*) are each connected with one high voltage rectifier (13, 13*a*, 15, 17, 19, 21, 24, and 26), and whose primary windings (8, 9, 8*a*, 9*a*) are each connected to one inverter output (4*a*, 4*b*, 5*a*, and 5*b*).

2. An x-ray diagnostic generator according to claim 1, characterized in that the high voltage rectifiers are full wave rectifiers (13, 13*a*).

3. An x-ray diagnostic generator according to claim 1, characterized in that each high voltage rectifier comprises a voltage doubling circuit (15 through 26) for the output voltage of the corresponding high voltage secondary part (11, 12, 11*a*, 12*a*).

* * * * *